US007549626B2

(12) United States Patent
Cook et al.

(10) Patent No.: US 7,549,626 B2
(45) Date of Patent: Jun. 23, 2009

(54) MEDIA TIMING BASED ON STACK HEIGHT FOR USE WITHIN AN IMAGE FORMING DEVICE

(75) Inventors: William Paul Cook, Lexington, KY (US); Daniel L. Carter, Georgetown, KY (US); Niko Jay Murrell, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 447 days.

(21) Appl. No.: 11/221,459

(22) Filed: Sep. 8, 2005

(65) Prior Publication Data

US 2007/0052155 A1 Mar. 8, 2007

(51) Int. Cl.
*B65H 5/00* (2006.01)

(52) U.S. Cl. ..... 271/10.02; 271/242; 271/270

(58) Field of Classification Search ..... 271/10.02, 271/145, 3.15, 3.16, 242, 244, 10.03, 10.12, 271/270; 399/23, 395; 400/619, 630
See application file for complete search history.

(56) References Cited

U.S. PATENT DOCUMENTS 3,902,713 A 9/1975 Von Lühmann et al.
3,944,360 A * 3/1976 Deetz et al. ..... 399/23
3,968,364 A 7/1976 Miller
4,566,547 A 1/1986 Furukawa
4,638,987 A 1/1987 Sakurai
4,721,297 A 1/1988 Katayama
4,864,124 A 9/1989 Mirabella, Jr. et al.
4,986,525 A 1/1991 Takagi et al.
5,078,379 A 1/1992 Leisner
5,098,080 A 3/1992 Arnone et al.
5,177,544 A 1/1993 Kimura et al.
5,200,608 A 4/1993 Kitajima
5,207,416 A 5/1993 Soler
5,211,690 A 5/1993 Mizoguchi et al.
5,226,639 A 7/1993 Kida et al.
5,480,132 A 1/1996 Kiyohara et al.
5,518,230 A 5/1996 Scarlata et al.
5,601,281 A 2/1997 Kubodera et al.
5,622,364 A 4/1997 Dutton et al.
5,691,826 A 11/1997 Yeh et al.
5,700,003 A 12/1997 Sung
5,755,435 A 5/1998 Fujiwara
5,823,529 A 10/1998 Mandel et al.
5,839,015 A 11/1998 Faguy et al.
5,842,694 A 12/1998 Brooks et al.
5,854,696 A 12/1998 Yun (Continued)

*Primary Examiner*—Patrick H Mackey
*Assistant Examiner*—Jeremy Severson
(74) *Attorney, Agent, or Firm*—Coats & Bennett PLLC

(57) ABSTRACT

Methods and devices for moving media sheets through an image forming device. A sensor is positioned within an input area to determine a height of a media stack. When the media stack is full, a top-most sheet of the media stack is physically closer to the beginning point of the media path. When the media stack is depleted, the top-most sheet is positioned a further distance away from the beginning point. Movement of the media sheet is determined based on the height of the media stack. When the media stack is above a predetermined amount, the media sheet is moved according to a first algorithm. When the media stack is below the predetermined amount, the media sheet is moved according to a second algorithm.

19 Claims, 5 Drawing Sheets

U.S. PATENT DOCUMENTS 5,897,112 A 4/1999 Kwag
5,915,690 A 6/1999 Surya
5,941,518 A * 8/1999 Sokac et al. ..... 271/10.05
5,961,115 A 10/1999 Blanck et al.
6,000,871 A 12/1999 Fisher, Sr.
6,100,993 A 8/2000 Eom
6,139,010 A 10/2000 Yokoi
6,148,172 A * 11/2000 Kanda et al. ..... 399/391
6,206,362 B1 3/2001 Tan et al.
6,252,654 B1 6/2001 Kaya
6,493,518 B2 * 12/2002 Park ..... 399/23
6,567,620 B2 * 5/2003 Brown et al. ..... 399/18
6,585,344 B2 7/2003 Kolodziej
6,592,119 B2 7/2003 Goldbeck et al.
6,639,238 B2 10/2003 Kuo et al.
6,679,490 B2 1/2004 Pioquinto et al.
6,724,506 B1 4/2004 Wang
6,834,166 B2 * 12/2004 Fujikura ..... 399/23
2004/0094891 A1 * 5/2004 Trovinger et al. ..... 271/227
2004/0150154 A1 * 8/2004 Howe ..... 271/228

* cited by examiner

MEDIA TIMING BASED ON STACK HEIGHT FOR USE WITHIN AN IMAGE FORMING DEVICE

BACKGROUND

Image forming devices move media sheets along a media path. The media sheets initially begin at an input area that is sized to hold a stack of sheets. Each sheet is individually picked from the stack and introduced into the media path. The media path comprises a series of roller nips, guides, and/or belts. The sheets move along the media path and through an imaging area where an image is transferred to the sheet. The media sheet is then either output from the device, or recirculated through a duplex path for receiving an image on a second side.

Media sheets are moved from the input area and into the media path in a timely manner. The distance between sheets moving along the media path is preferably minimized to increase the overall throughput of the device. The device throughput is the number of media sheets that receive a toner image and are outputted from the device within a given time period. Higher throughput devices are usually preferred by users.

The timing for moving a media sheet from the input area varies depending upon the height of the media stack. When the stack is full, the distance the media sheet moves before entering the media path is small. As the stack is depleted, the distance into the media path increases. Compensation is necessary to maintain a minimum inter-page gap as the stack height is reduced.

The movement of the media sheets from the input area and along the media path should occur without media jams or print defects. Media jams require the user to determine the location of the jam, access and remove the jammed sheet(s), and restart the image formation process.

Movement of the media sheets is also important to prevent print defects. Print defects occur when the media sheet is not properly aligned when moving through the imaging area. Misalignment may occur in the scan directions (i.e., left and right), as well as the process directions (i.e., forward and backward).

SUMMARY

The present application is directed to methods and devices for moving media sheets within an image forming device. A sensor may be positioned within an input area to determine a height of a media stack. When the media stack is full, a top-most sheet of the media stack is physically closer to the beginning point of the media path. When the media stack is depleted, the top-most sheet is positioned a further distance away from the beginning point. Movement of the media sheet is determined based on the height of the media stack. When the media stack is above a predetermined amount, the media sheet is moved according to a first algorithm. When the media stack is below the predetermined amount, the media sheet is moved according to a second algorithm.

DETAILED DESCRIPTION

Figure 1:
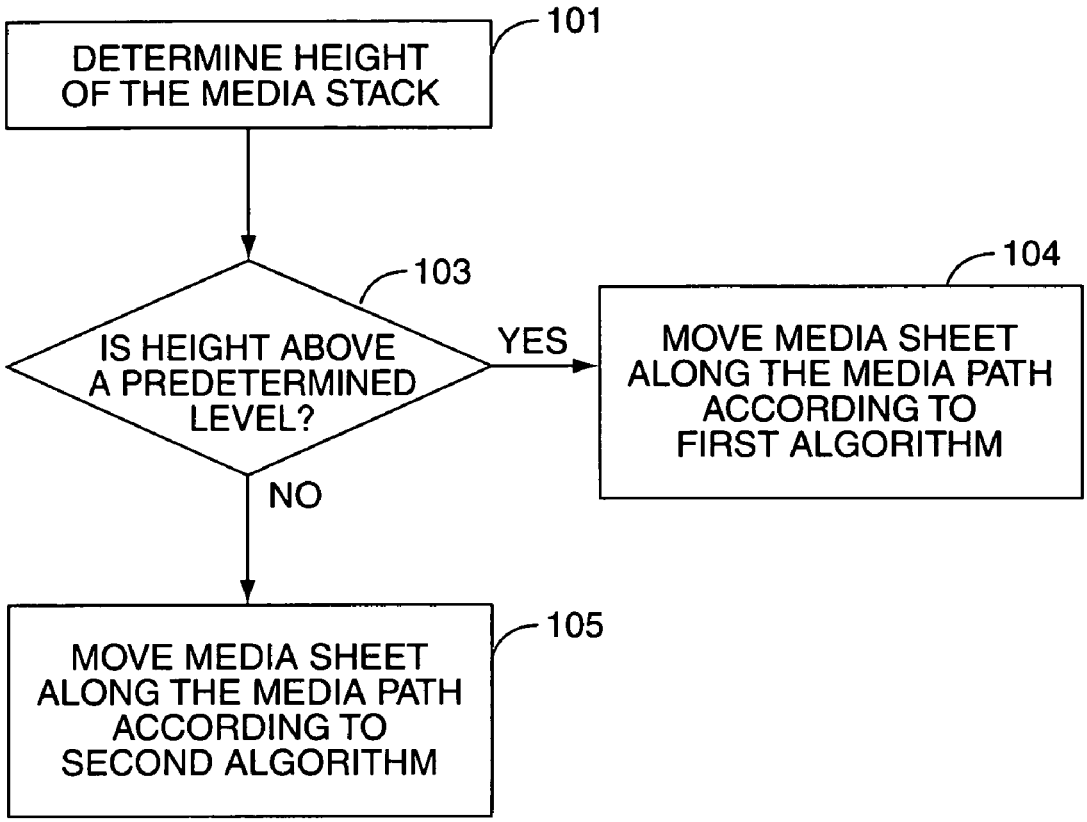
FIG. 1 is a flowchart diagram of a method of moving media sheets according to one embodiment of the present invention.

The present application is directed to media timing for moving media sheets through an image forming device. One embodiment of the application is illustrated in FIG. 1. A sensor positioned within an input area determines a height of a media stack (step 101). When the media stack is full, a top-most sheet of the media stack is physically closer to the beginning point of the media path. When the media stack is depleted, the top-most sheet is positioned a further distance away from the beginning point. Therefore, the height of the media stack determines the movement of the media sheet (step 103). When the media stack is above a predetermined amount, the media sheet is moved according to a first algorithm (step 104). When the media stack is below the predetermined amount, the media sheet is moved according to a second algorithm (step 105). The algorithms may include both when the media sheet is picked, and the speed of movement of the media sheet along the media path.

Figure 2:
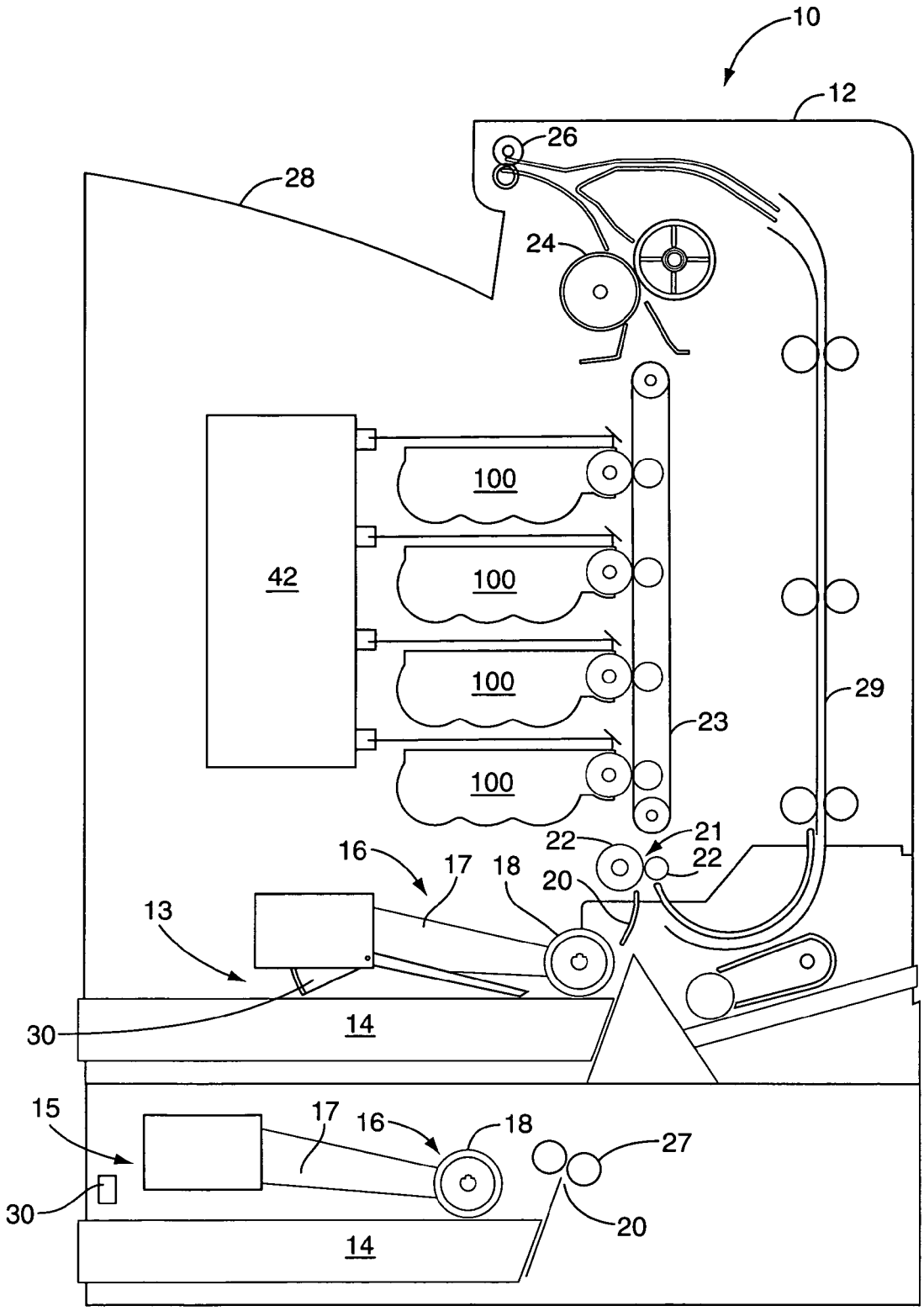
FIG. 2 is a schematic diagram of an image forming device according to one embodiment of the present invention.

FIG. 2 depicts a representative image forming device, such as a printer, indicated generally by the numeral 10. The image forming device 10 comprises a main body 12, a first input area 13 holding a first stack 14 of media sheets, and a second input area 15 for holding a second stack 14 of media sheets. Each of the input areas includes a non-movable floor for storing the media stacks 14. The second input area 15 may be a high capacity input for holding a larger number of media sheets than can be accommodated in the first input area 13. In one embodiment, second input area 15 accommodates a stack of 500 media sheets. Pick mechanisms 16 move media sheets from the media stacks 14 into the media path 20.

The input areas 13, 15 are disposed in a lower portion of the main body 12, and each is preferably removable for refilling. Pick mechanisms 16 pick the top-most sheet from each stack and move the sheet into the media path 20. The term "pick" refers to moving the media sheet from the media stack 14 into the media path 20. Registration nip 21 formed between rolls 22 align the media sheet prior to passing to a transport belt 23 and past a series of image forming stations 100. A print system 42 forms a latent image on a photoconductive member in each image forming station to form a toner image. The toner image is then transferred from the image forming station 100 to the passing media sheet.

Color image forming devices typically include four image forming stations 100 for printing with cyan, magenta, yellow, and black toner to produce a four-color image on the media sheet. The transport belt 23 conveys the media sheet with the color image thereon towards a fuser 24, which fixes the color image on the media sheet. Exit rollers 26 either eject the print media to an output tray 28, or direct it into a duplex path 29 for printing on a second side of the media sheet. In the latter case, the exit rollers 26 partially eject the print media and then reverse direction to invert the media sheet and direct it into the duplex path 29. A series of rollers in the duplex path 29 return the inverted print media to the primary media path for printing on the second side.

Pick mechanisms 16 comprise a pivoting arm 17 and a rotating member 18 that rests on the top-most sheet. A stationary floor supports the media stacks 14 in each of the input areas 13, 15. As the media stack 14 is depleted, the location of the top-most sheet moves further from the beginning of the media path 20. The pivoting arm 17 pivots downward with the member 18 remaining in contact with the top-most media sheet in the stack 14.

A media sensor 30 detects the amount of media contained in the media stack 14. In one embodiment, sensor 30 detects a precise height of the media sheets that remain with the stack 14. The precise height may be detected to a predetermined fraction of an inch. In one specific embodiment, sensor 30 detects the stack height within ⅛ inch. Sensor 30 may also detect the stack height within a predetermined range. A specific embodiment detects whether the stack height is full, ¾ full, ½ full, ¼ full, and empty.

Figure 3:
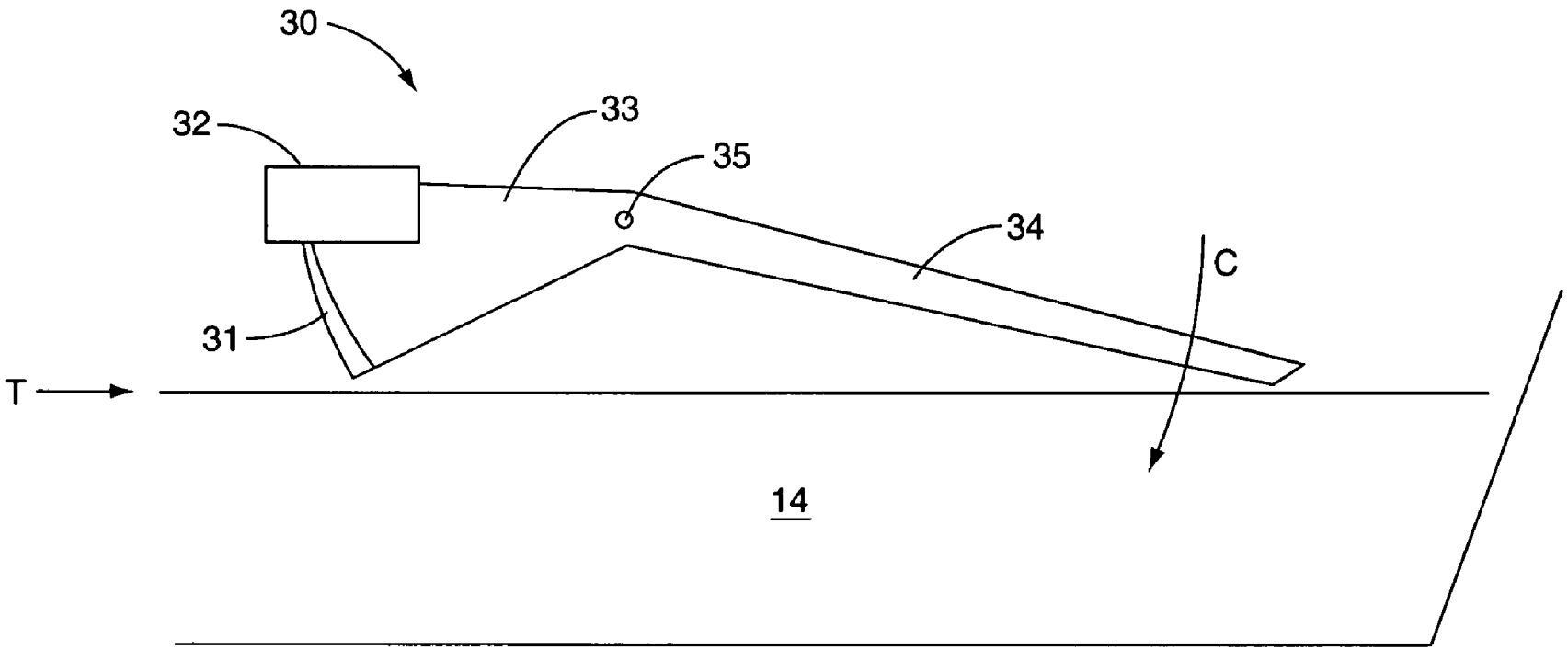
FIG. 3 is a schematic diagram of a stack height sensor according to one embodiment of the present invention.

FIG. 3 illustrates one embodiment of a sensor 30. Sensor 30 includes a sensing member 32 and an actuator 33. The actuator 33 has a flag 31 and an arm 34 that pivot about axis 35. The pivot axis 35 is generally parallel to the sheets contained in the media stack 14. The arm 34 is biased in the direction indicated by the arrow labeled C into contact with the uppermost sheet T of the media stack 14. In the embodiment shown, there is no external bias element and the arm tends to swing downward under its own weight. However, in other embodiments, an external bias force may be applied by coil springs, leaf springs, or the like.

Since arm 34 is biased into contact with the uppermost sheet T of the stack 14, the position of the arm 34 will change as the height of the stack 14 (and hence, the location of surface T) changes. The flag 31 is coupled to the arm 34 and also changes position as the height of the stack 14 changes. Sensing member 32 is stationary and the position of the flag 31 relative to sensing member 32 changes according to the height of the stack 14. In FIG. 3, the media stack is relatively full and the arm 34 is in a first pivotal position. As the stack 14 is depleted, arm 34 pivots downward relative to the pivot axis 35. The sensing member 32 determines the position of the flag 31 as the arm 34 pivots based on the media stack height. This determination is used to detect the overall stack height. One embodiment of a media stack height sensor is disclosed in U.S. patent application Ser. No. 10/970,774 filed on Oct. 21, 2004 entitled "Media Tray Stack Height Sensor with Continuous Height Feedback and Discrete Intermediate and Limit States", assigned to Lexmark International, Inc., and hereby incorporated by reference in its entirety.

Figure 4:
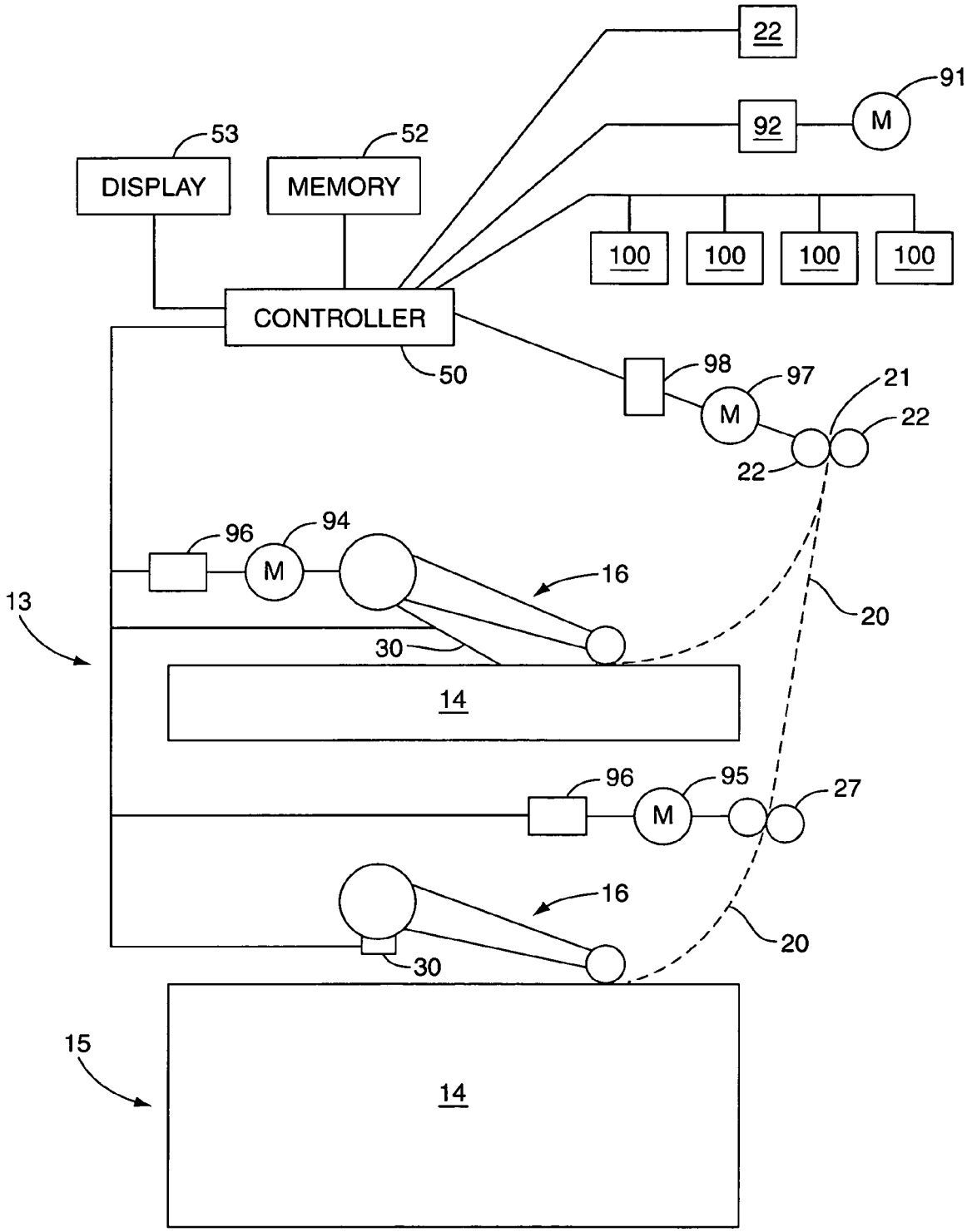
FIG. 4 is a schematic diagram of a first section of the media path and a controller according to one embodiment of the present invention.

Controller 50 oversees the timing of the toner images and the media sheets to ensure the two coincide at the image transfer area. As illustrated in FIG. 4, controller 50 may include a microcontroller with associated memory 52. In one embodiment, controller 50 includes a microprocessor, random access memory, read only memory, and in input/output interface. Controller 50 controls when the laser assembly 22 begins to place the latent image on the photoconductive drums within the image forming units 100. Controller 50 may monitor scan data from the laser assembly 22 and the number of revolutions and rotational position of drum motor 91 that drive the photoconductive drums in the image forming units 100. In one embodiment, the number of revolutions and rotational position of drum motor 91 is ascertained by an encoder 92.

Controller 50 may also send signals to a display 53 for viewing by the user. Displayed information may include the remaining stack height within one or both of the input areas 13, 15, or the number of remaining sheets. The remaining sheet display may include a precise number of remaining sheets, or may include a range of remaining sheets (e.g., ¼ stack remaining, ½ stack remaining). In one embodiment, the number of remaining sheets is calculated by the controller determining the type of media sheets within the input areas. This may be obtained by user input, or by establishing a default setting. Controller 50 then determines the sheet thickness based on stored information stored within memory 52. Once the sheet thickness is known, the remaining number of sheets is determined by dividing the remaining stack height by the sheet thickness. In another embodiment, controller 50 determines the remaining sheets through an iterative process that tracks the height of the stack 14 and the number of picked sheets. As the stack height decreases, controller 50 compares the number of picked sheets to the decrease in the stack height. The decrease is then divided by the number of picked sheets to determine the thickness of each sheet which can then be used to determine the remaining number of sheets.

Controller 50 further controls the pick mechanisms 16 to move a media sheet from the stack 14 along the media path 20 to intercept the toner image. Controller 50 begins tracking incrementally the position of the media sheet by monitoring the feedback of encoder 96 associated with the pick mechanism motors 94, 95. One embodiment of a tracking system is disclosed in U.S. Pat. No. 6,330,424, assigned to Lexmark International, Inc., and herein incorporated by reference in its entirety.

A drawback to previous systems is the inability to determine the position of the media sheet as it moves along the media path 20. This is caused because the starting point of the media sheet varies depending upon the height of the media stack. When the stack is full, the media sheet is moved from the input area 13, 15 in a shorter amount of time than when the stack is nearly depleted. For a large capacity input area such as a 500 sheet capacity, a difference of about 2 inches results depending upon the size of the stack when the sheet is picked.

To overcome this obstacle, media stack height sensors 30 are positioned in the input areas 13, 15. Controller 50 determines the starting point of the media sheet based on the height of the stack when the sheet is picked. With the starting point known, controller 50 is able to accurately track the position of the media sheet through the initial section of the media path 20 from the feedback from pick mechanism encoders 96. No other sensors are positioned along the initial media path 20 between the input areas 13, 15 and the aligner nip 22. Controller 50 may use different movement algorithms to move the media sheet depending upon the height of the media stack. The algorithms may include different pick times and different media speeds. These algorithms may be stored in a look-up table in memory 52, or may be calculated at the time of implementation.

Once controller 50 determines that the leading edge has moved to a predetermined point along the media path 20, controller 50 directs the aligner nip 22 to begin rotation in a reverse direction. A first algorithm begins the reverse rotation at a first time from the beginning of the pick. A second algorithm begins the reverse rotation at a second, different time from the beginning of the pick. It is important that that the media sheet reach the aligner nip 22 during reverse rotation to remove any lateral skew. In the event that sheet arrives late (i.e., after the aligner nip 22 has stopped reverse rotation), the lateral skew will not be removed. If the media sheet arrives early (i.e., before the aligner nip 21 begins reverse rotation), the media sheet will be stopped for an extended time thus slowing device throughput.

Figure 5A:
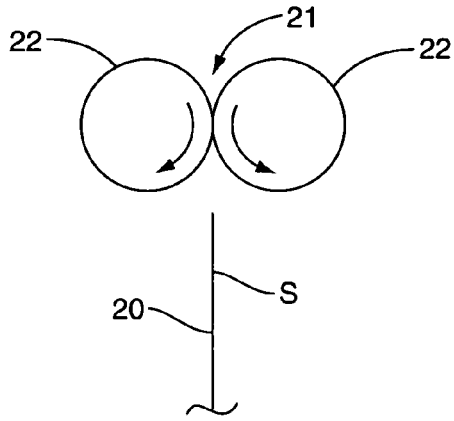
FIGS. 5*a*-5*c* are schematic diagrams illustrating a media sheet moving into and through an aligner nip according to one embodiment of the present invention.
Figure 5B:
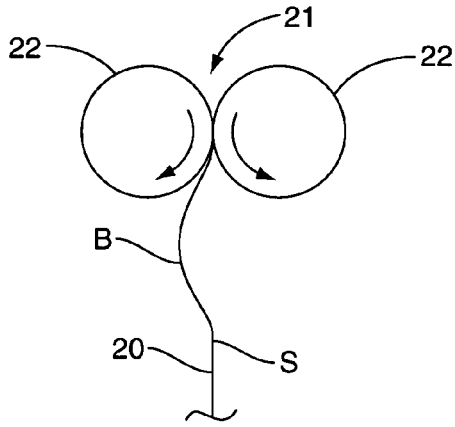
Figure 5C:
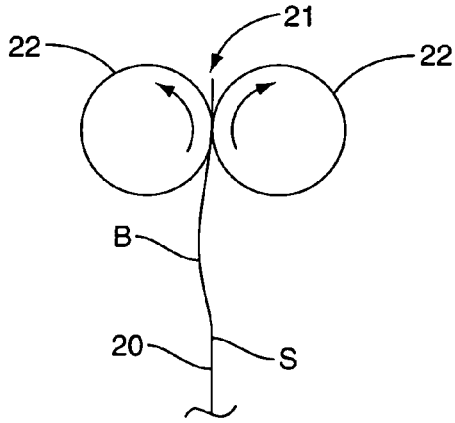

Reverse rotation of the aligner nip 22 laterally aligns the media sheet. FIGS. 5*a*-5*c* illustrate the lateral alignment process. As the media sheet S approaches along the media path 20, rollers 22 are rotated in a reverse direction as illustrated in FIG. 5*a*. The media sheet S continues to move along the media path 20 as the leading edge contacts rollers 22 as illustrated in FIG. 5*b*. The reverse movement of the rollers 22 prevents the leading edge from entering into the nip 21 and stops the forward progress. A buckle B in the media sheet S forms as the leading edge is stopped and the media sheet S continues to be driven from the input areas 13, 15. The buckle B causes the leading edge to laterally align within the nip 21. After a predetermined period, rollers 22 begin rotation in a forward direction as illustrated in FIG. 5*c*. The leading edge of the media sheet S moves into and through the nip 21. The rollers 22 may be accelerated in the forward direction such that the amount of buckle B is reduced or completely eliminated.

Another area where multiple algorithms may be used is illustrated in FIG. 4. Feed-through rolls 27 are positioned along the media path 20 between the pick mechanism 16 and the aligner nip 21. The feed-through rolls 27 are necessary because the pick mechanism 16 is unable to move the media sheet from the second input area 15 to the aligner nip 21. In the embodiment illustrated, the distance between the second input area 15 and the aligner nip 21 is greater than the length of the media sheet. The trailing edge of the media sheet would clear the pick mechanism 16 prior to the leading edge contacting the aligner nip 21. Feed-through rolls 27 fill the distance and ensure the media sheet keeps moving along the media path 20.

A common motor 95 drives both the feed-through rolls 27 and the pick mechanism 16. When the motor 95 is driven in a first direction, pick mechanism 16 operates and drives the media sheet from the second input area 15. When the motor 95 is driven in a second direction, feed-through rolls 27 rotate to drive the media sheet along the media path 20 and into the aligner nip 21. One embodiment of a common motor arrangement is disclosed in U.S. patent application Ser. No. 10/803,822 filed on Mar. 18, 2004 entitled "Input Tray and Drive Mechanism Using a Single Motor for an Image Forming Device", assigned to Lexmark International, Inc., and hereby incorporated by reference in its entirety.

Media stack height sensor 30 in the second input area 15 detects the height of the media and forwards a signal to controller 50. If the sensor 30 detects that the stack height is high (i.e., a large amount of media sheets), motor 95 is driven in a first direction for a relatively short time period that is adequate to move the media sheet into the feed-through rolls 27. Conversely, if sensor 30 detects that the height is low (i.e., a small amount of media sheets), motor 95 is driven in the first direction for a longer time period that is adequate to ensure that the leading edge reaches the feed-through rolls 27.

The shared motor arrangement does not allow for both the pick mechanism 16 and the feed-through rolls 27 to move the media sheet at the same time. Without a media stack height sensor 30, controller 50 may have to assume that the media stack is low to ensure that the leading edge always reaches the feed-through rolls 27.

The input areas 13, 15 may be equipped with the same type or different types of media stack height sensors 30. One type of sensor is described above and illustrated in FIG. 3. Another embodiment features a sensor 30 having an optical source to emit optical energy that is received at an optical detector.

One embodiment of the lateral skew correction includes the aligner rollers 22 rotating in a reverse direction when the leading edge of the media sheet makes contact. In another embodiment, the rollers 22 are stationary and do not begin reverse rotation until after contact by the leading edge. In yet another embodiment, the rollers 22 are stationary when initially contacted by the leading edge. The leading edge is forced into the nip 21 and thus any skew is corrected by the continued movement of the sheet in the forward direction. After a predetermined time, the rollers 22 rotate in a forward direction to continue moving the media sheet to the image formation area.

As illustrated in FIG. 1, one embodiment includes that the media sheets are moved along the media path according to a different first or second algorithms depending upon the stack height. In another embodiment, the first and second algorithms are the same. However, the same first and second algorithms result in different media pick timings due to the differences in stack height.

The present invention may be carried out in other specific ways than those herein set forth without departing from the scope and essential characteristics of the invention. In one embodiment, a single drum motor 91 drives each of the photoconductive drums. In another embodiment, two or more drum motors drive the plurality of photoconductive drums. When the trailing edge of the media sheet moves beyond the pick mechanism 16, controller 50 tracks other encoders along the media path 20, such as encoder 98 from motor 97 that drives one of the aligner nip rolls 22. The present embodiments are, therefore, to be considered in all respects as illustrative and not restrictive, and all changes coming within the meaning and equivalency range of the appended claims are intended to be embraced therein.

What is claimed is:

1. A method of moving a media sheet within an image forming device, the method comprising the steps of:

detecting a height of a media stack within an input area;

determining a first travel time to move from the media stack to a predetermined point along a media path downstream from the input area according to a first feed algorithm;

determining a second travel time to move from the media stack to the predetermined point along the media path downstream from the input area according to a second feed algorithm;

moving the media sheet according to the first feed algorithm when the height of the media stack is above a predetermined amount;

moving the media sheet according to the second feed algorithm when the height of the media stack is below the predetermined amount;

starting rotation of an aligner nip located along the media path in a reverse direction based on the height of the media stack in the input area; and forming a toner image on the media sheet at a point downstream from the input area.

2. The method of claim 1, further comprising depleting the media stack and increasing a distance from the media stack to the media path.

3. The method of claim 1, wherein the steps of moving the media sheet according to the first feed algorithm and the second feed algorithm comprises picking the media sheet from a top of the media stack.

4. The method of claim 1, further comprising accessing the first feed algorithm and the second feed algorithm from a look-up table stored in memory.

5. The method of claim 1, further comprising displaying a remaining amount of media sheets within the input area.

6. A method of moving a media sheet within an image forming device, the method comprising the steps of:

detecting a height of a media stack within an input area;

determining a first travel time to move from the media stack to a predetermined point along a media path downstream from the input area according to a first feed algorithm;

determining a second travel time to move from the media stack to the predetermined point along the media path downstream from the input area according to a second feed algorithm;

moving the media sheet according to the first feed algorithm when the height of the media stack is above a predetermined amount;

moving the media sheet according to the second feed algorithm when the height of the media stack is below the predetermined amount;

driving a motor in a first direction and feeding the media sheet from the input area and reversing a direction of the motor and moving the media sheet through a feed-through roll in the media path, the start of reversing the direction of the motor based on the height of the media stack in the input area; and forming a toner image on the media sheet at a point downstream from the input area.

7. A method of moving a media sheet within an image forming device, the method comprising the steps of:

determining a height of a media stack within an input area;

moving a media sheet from the input area along a media path to an aligner nip;

operating the aligner nip based on the height of the media stack and forming a buckle in the media sheet;

moving the media sheet through the aligner nip; and forming a toner image on the media sheet.

8. The method of claim 7, wherein the step of determining the height of the media stack within the input area comprises determining a range of the height of the media stack.

9. The method of claim 7, wherein the step of moving the media sheet from the input area comprises moving the media sheet from a top of the media stack.

10. The method of claim 7, further comprising rotating the aligner nip in a reverse direction prior to contact with a leading edge of the media sheet.

11. The method of claim 7, further comprising rotating the aligner nip in a reverse direction after contact with a leading edge of the media sheet.

12. The method of claim 7, further comprising moving the media sheet through a feed-through nip positioned between the input area and the aligner nip.

13. The method of claim 12, further comprising driving the feed-through nip and a pick mechanism in the input area with a common motor.

14. The method of claim 7, further comprising displaying a remaining amount of media sheets within the input area.

15. A method of moving media sheets within an image forming device, the method comprising the steps of:

storing a stack of media sheets within an input area;

determining a height of the stack and picking and moving a first media sheet from a top of the stack according to a first algorithm;

forming an image on the first media sheet;

moving a plurality of media sheets from the stack and depleting the height of the stack; thereafter, determining the height of the stack and picking and moving a second media sheet from the top of the stack according to a second algorithm;

activating an aligner nip downstream from the input area based on the height of the stack; and forming a second image on the second media sheet.

16. The method of claim 15, wherein movement of the media sheet from the input area is substantially the same in the first algorithm and the second algorithm.

17. The method of claim 15, further comprising displaying a remaining amount of media sheets within the input area.

18. A method of moving media sheets within an image forming device, the method comprising the steps of:

storing a stack of media sheets within an input area;

determining a height of the stack and picking and moving a first media sheet from a top of the stack according to a first algorithm;

forming an image on the first media sheet;

moving a plurality of media sheets from the stack and depleting the height of the stack; thereafter, determining the height of the stack and picking and moving a second media sheet from the top of the stack according to a second algorithm;

activating a feed-through nip downstream from the input area based on the height of the stack; and forming a second image on the second media sheet.

19. A method of moving a media sheet within an image forming device, the method comprising the steps of:

detecting a height of a media stack within an input area;

determining a first travel time to move from the media stack to a predetermined point along a media path downstream from the input area according to a first feed algorithm;

determining a second travel time to move from the media stack to the predetermined point along the media path downstream from the input area according to a second feed algorithm;

moving the media sheet according to the first feed algorithm when the height of the media stack is above a predetermined amount;

moving the media sheet according to the second feed algorithm when the height of the media stack is below the predetermined amount, the moving of the media sheet according to the second feed algorithm further comprises driving a motor in a first direction and feeding the media sheet from the input area and reversing a direction of the motor and moving the media sheet through a feed-through roll in the media path, the start of reversing the direction of the motor based on the height of the media stack in the input area; and forming a toner image on the media sheet at a point downstream from the input area.

* * * * *